US006019593A

United States Patent [19]

Lewandowski et al.

[11] Patent Number: 6,019,593

[45] Date of Patent: Feb. 1, 2000

[54] INTEGRATED GAS BURNER ASSEMBLY

[75] Inventors: Troy R. Lewandowski, Maumee, Ohio; Ben M. Balestra, Temperance, Mich.

[73] Assignee: Glasstech, Inc., Perrysburg, Ohio

[21] Appl. No.: 09/181,292

[22] Filed: Oct. 28, 1998

[51] Int. Cl.[7] ..... F23N 11/44

[52] U.S. Cl. ..... 431/12; 431/89; 431/18; 431/90

[58] Field of Search ..... 431/12, 89, 90, 431/18; 126/351, 116 A; 137/9

[56] References Cited

U.S. PATENT DOCUMENTS

| | | | |
|---|---|---|---|
| 3,960,320 | 6/1976 | Slater | 236/15 B |
| 4,385,887 | 5/1983 | Yamamoto et al. | 431/90 |
| 4,994,959 | 2/1991 | Ovenden et al. | 431/12 |
| 5,400,962 | 3/1995 | Adams et al. | 431/12 |
| 5,401,162 | 3/1995 | Bonne | 431/12 |
| 5,406,840 | 4/1995 | Boucher . | |
| 5,513,979 | 5/1996 | Pallek et al. | 431/12 |
| 5,630,408 | 5/1997 | Versluis | 431/12 |
| 5,685,707 | 11/1997 | Ramsdell et al. . | |

*Primary Examiner*—Ira S. Lazarus
*Assistant Examiner*—David Lee
*Attorney, Agent, or Firm*—Brooks & Kushman P.C.

[57] ABSTRACT

A gas burner assembly (10) and method for providing combustion air flow and gas fuel flow in linear proportion to a control signal. A blower motor (18) is driven by the control signal and drives a blower (14) whose output (16) has a static pressure proportional to the square of the blower speed. A gas fuel controller 28 is responsive to the static pressure of the blower output (16) to meter fuel in proportion to the square root of that static pressure.

18 Claims, 3 Drawing Sheets

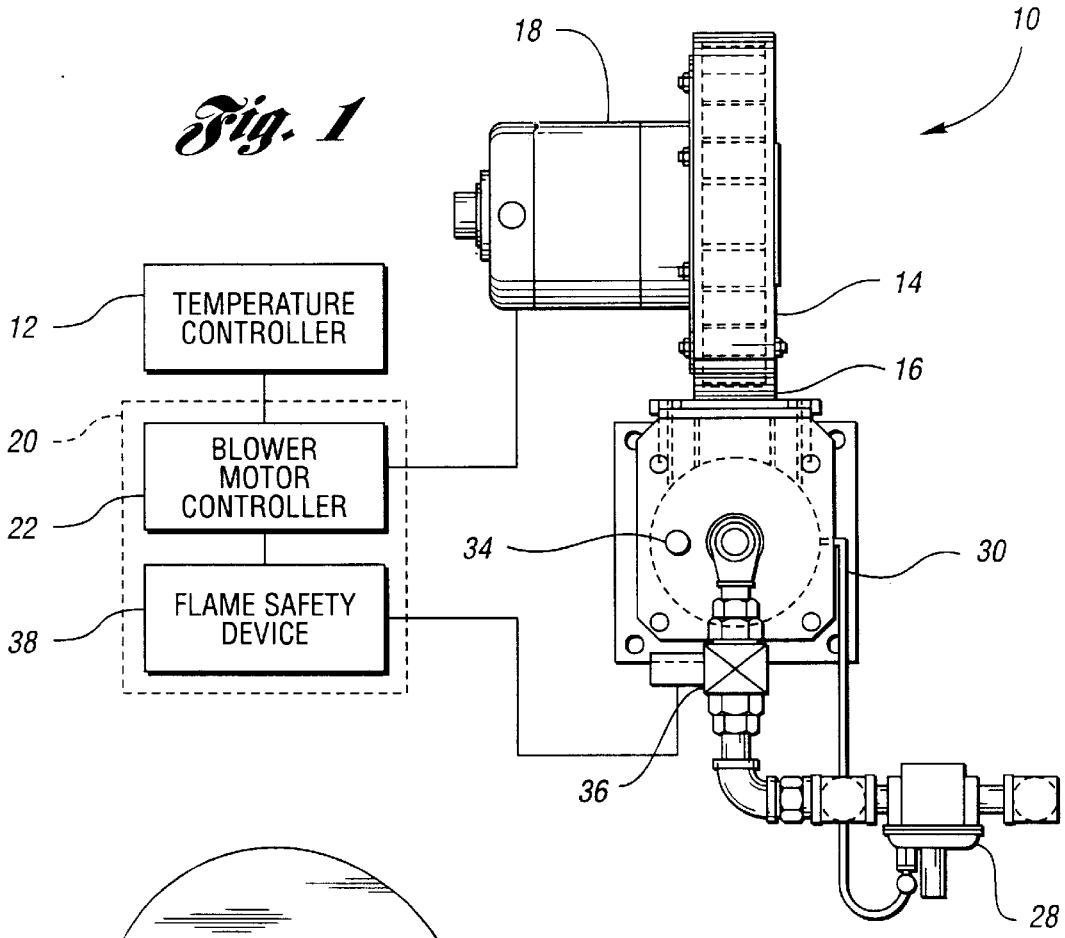
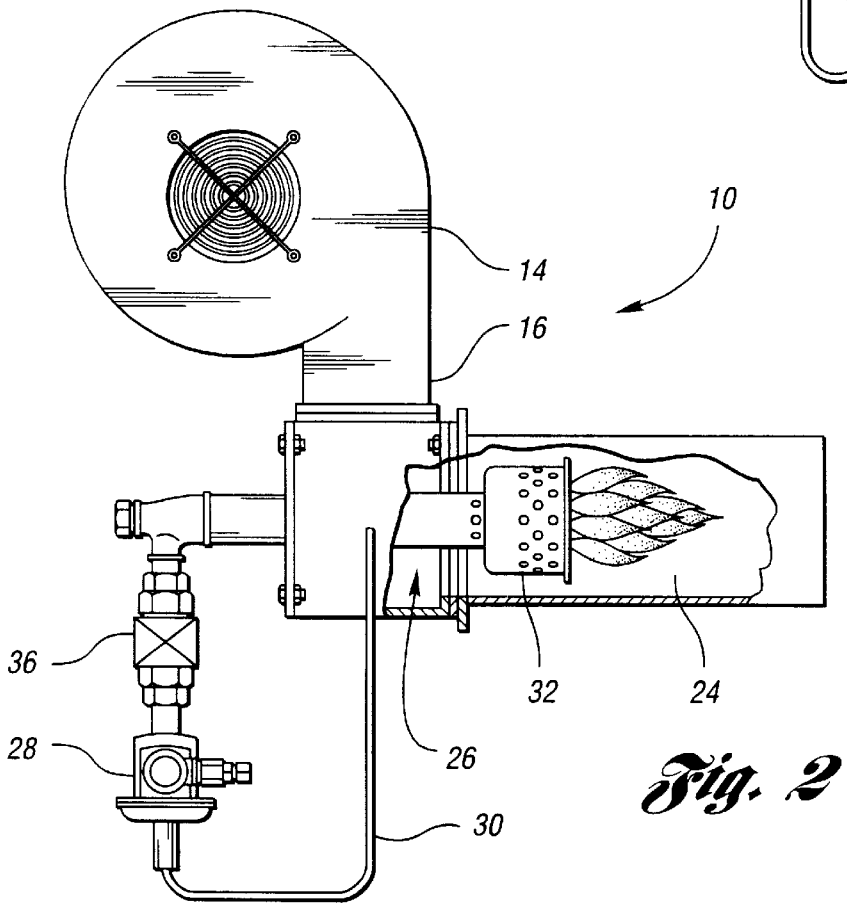
Fig. 2

INTEGRATED GAS BURNER ASSEMBLY

TECHNICAL FIELD

This invention relates to "integrated" or "packaged" gas burner assemblies used in industrial process heating applications, such as multi-zone furnaces used in the forming or other processing of glass sheets.

BACKGROUND ART

Modern furnaces, such as those used in sheet glass forming, typically include multiple sections or "zones" wherein heated combustion products from a plurality of discrete gas burner assemblies are used to carefully maintain desired temperatures throughout these zones while further responding to variations in attendant heat loads. For example, the passage of a workpiece, such as a glass sheet, through these zones induces temperature variations within each zone which must be corrected in real time in order to achieve the desired heating of the workpiece.

More specifically, when a relatively large heat input must be applied to the furnace and its load, in order to maintain the setpoint temperature of the furnace and to ensure that the desired rate of heat transfer to the load is achieved, the output of the burner systems will increase in response to the thermal loading. The output of the gas burners may increase to 100% of the burner's rate capacity which is referred to as "high-fire". At a later stage in the process, as the load begins to approach the set point temperature, the heat input applied by the burner must be lowered to prevent overheating. The output of the burner systems will then decrease in response to the thermal loading. The output of the burners may decrease to 10% (or less) of the burner's rated capacity which is referred to as "low-fire". The ratio of the maximum to the minimum thermal output of a burner is referred to as the turndown ability of the system. Modern furnace construction provides for minimal heat loss at operating temperatures, with an attendant requirement of relatively high turndown ratios of at least 10 to 1.

Two common ways of achieving turndown are thermal turndown and stoichiometric turndown. During thermal or "excess air" turndown, the flow of fuel is reduced while the air flow is held constant, effectively lowering the fuel-to-air ratio. Because the excess combustion air is heated by combustion, the released heat is diluted and the temperature of the combustion products exiting the burner's combustion chamber is effectively reduced.

Under the preferred approach, thermal turndown is achieved by reducing both combustion air and fuel so as to simultaneously increase the amount of excess combustion air in relation to the fuel. At the high-fire rate, the level of excess air is 10% which is very close to stoichiometric. At the low-fire rate, the level of excess air is 1000%. Under the preferred approach, the turndown of fuel is 28:1. The 1000% excess air reduces the hot mix temperature of combustion products which further reduces the thermal output of the burner. The effective thermal turndown then becomes 100:1 or greater which yields excellent control of furnace temperatures for all loading conditions.

Under one prior art burner capable of high thermal turndown, a constant-speed blower is used to supply combustion air to the combustion chamber of a given burner assembly. A butterfly valve located between the blower discharge and the combustion chamber is adjusted from a minimum flow, "low-fire" position (typically an almost closed position) through a maximum flow, "high-fire" position (often perhaps an 85 degree position due to flow nonlinearity through the butterfly valve) to thereby modulate the quantity of combustion air supplied to the combustion chamber in response to a demand signal. A proportional pressure regulator responsive to the static pressure in the burner assembly downstream of the butterfly valve meters the flow of fuel into the burner's combustor, whereby an appropriate air-fuel ratio is achieved within the combustion chamber for any given mass flow rate of combustion air between low-fire and high-fire conditions.

The butterfly valve of such prior art burners is typically set to a nearly closed position for low-fire to allow only the low-fire mass flow of air to enter the burner's combustion chamber. The valve may also be set to a fully closed position for low-fire with an appropriately sized bypass around the valve to allow only the low-fire mass flow of air to enter the burner's combustion chamber. The valve is typically driven itself from this low-fire position to its high-fire position using a dedicated stepper motor via a flexible coupling or linkage arrangement. In one prior art burner assembly, a sixteen-position stepper motor is employed, whereby the valve plate is driven between its low-fire and high-fire positions in equal increments of approximately 5 degrees of rotation per step. Adjustable limit switches are often used to indicate when the "low-fire" and "high-fire" valve plate positions are achieved.

The lost motion characteristic of such mechanical linkages and the relatively limited resolution of the stepper motor combine with the substantial nonlinear relationship between relative position of the valve plate and the corresponding mass flow rate of air through the butterfly valve to provide relatively limited control of the heat output of the burner assembly, with the further likelihood that the burner assembly will undesirably "hunt" between an upper and lower level of heat output, with a resulting furnace temperature variance of perhaps 5° F. or greater.

Prior art gas burner assemblies are disclosed by U.S. Pat. Nos. 5,406,840 Boucher and 5,685,707 Ramsdell et al.

DISCLOSURE OF INVENTION

An object of the present invention is to provide an improved control of a gas burner assembly.

In carrying out the above object, a gas burner assembly for generating heated combustion products in response to a control signal includes a burner controller having a blower controller that receives the control signal and generates a variable frequency AC output whose frequency is proportional to the control signal. A blower motor of the assembly is driven by, and has a speed proportional to the frequency of, the AC output of the blower control. A blower driven by the blower motor generates a combustion air flow with a mass proportional to the speed of the blower motor, and the combustion air flow has a static pressure at a blower discharge location proportional to the square of the speed of the blower motor. A gas fuel controller of the burner assembly is responsive to the static pressure of the combustion air flow at the blower discharge location and provides a gas fuel flow whose mass flow is proportional to the square root of the static pressure of the combustion flow. A combustion chamber of the gas burner assembly receives the combustion air flow and the gas fuel flow for combustion.

The gas burner assembly in accordance with one aspect of the invention also has the frequency of the AC output of the blower controller varying substantially linearly in proportion to the control signal such that the combustion air mass flow and the gas fuel mass flow both vary substantially linearly in proportion to the control signal.

In accordance with another aspect of the invention gas burner assembly also has a minimum control signal that controls the blower controller to provide a low-fire condition where there is excess air that is a plurality of times the combustion air necessary for stoichiometric combustion with the gas fuel, and the gas burner has a maximum control signal that provides a high-fire condition where there is excess air that is only a fraction of the combustion air necessary for stoichiometric combustion with the gas fuel. The low-fire condition most preferably has excess combustion air that is about 10 times the combustion air necessary for stoichiometric combustion with the gas fuel, and the high-fire condition has excess combustion air that is about 10% of the combustion air necessary for the stoichiometric combustion of the gas fuel. The frequency of the AC output of the blower controller varies substantially linearly in proportion to the control signal between the minimum and maximum control signals such that the combustion air mass flow and the gas fuel mass flow also vary substantially linearly in proportion to the control signal between its minimum and maximum.

The gas burner assembly preferably has the blower controller generating the minimum control signal upon initial combustion of the burner assembly. An ignitor of the gas burner assembly is located in the combustion chamber and provides the initial combustion of the burner assembly. The burner controller can operate to control the operation of the ignitor and generate a maximum frequency AC output for a predetermined time prior to operating the ignitor which allows a furnace heated by the gas burner assembly to be purged of any natural gas prior to commencing the combustion. The gas fuel cut-off valve is disposed between the fuel controller and the combustion chamber and is closed by the burner controller to prevent the gas fuel flow during the predetermined time period prior to operation of the ignitor.

Another object of the present invention is to provide an improved method for controlling combustion of a gas burner assembly.

In carrying out the immediately preceding object, the method for controlling combustion of a gas burner assembly in accordance with the invention is provided by feeding a control signal to a blower controller that generates a variable frequency AC output proportional to the control signal. The method also involves driving a blower motor driven by, and at a speed proportional to, the frequency of the AC output of the blower controller. Driving a blower by the blower motor generates a combustion air flow with a mass flow proportional to the speed of the blower motor and with a static pressure at a blower discharge location proportional to the square of the speed of the blower motor. The method also involves controlling a gas fuel flow in response to the static pressure of the combustion air flow to provide a gas fuel mass flow proportional to the square root of the static pressure of the combustion air flow. Mixing of the combustion air flow and the gas fuel flow provides combustion.

In one aspect the method, the frequency of the output of the blower controller is varied substantially linearly in proportion to the control signal such that the combustion air mass flow and the gas fuel mass flow also both vary substantially linearly in proportion to the control signal. According to another aspect of the method, the control signal is varied between a minimum and a maximum, with the minimum control signal providing a low-fire condition where there is excess combustion air that is a plurality of times the combustion air necessary for stoichiometric combustion with the gas fuel, and with the maximum control signal providing a high-fire condition where there is excess combustion air that is a fraction of the combustion air necessary for stoichiometric combustion with the gas fuel. More specifically, the low-fire condition is provided with excess combustion air that is about 10 times the combustion air necessary for stoichiometric combustion with the gas fuel, and the high-fire condition has excess combustion air that is about 10% of the combustion air necessary for stoichiometric combustion with the gas fuel. The frequency of the AC output of the blower controller is varied substantially linearly in proportion to the control signal between its minimum and maximum such that the combustion air mass flow and the gas fuel mass flow also both vary substantially linearly in proportion to the control signal between its minimum and maximum.

In another aspect of the method, the blower controller generates the minimum control signal upon initial combustion of the burner assembly and an ignitor provides the initial combustion of the burner assembly. Furthermore, the blower controller drives the blower motor by a maximum frequency AC output for a predetermined time prior to operation of the ignitor to provide the initial combustion in order to allow purging of a furnace with which the gas burner assembly is utilized. There is no gas fuel flow during the predetermined time period prior to operation of the ignitor.

BRIEF DESCRIPTION OF DRAWINGS

FIG. 1 is an end elevational view, partially in schematic, of an exemplary burner assembly in accordance with the invention.

FIG. 2 is a side elevational view of the exemplary burner assembly of FIG. 1.

BEST MODE FOR CARRYING OUT THE INVENTION

Figure 3:
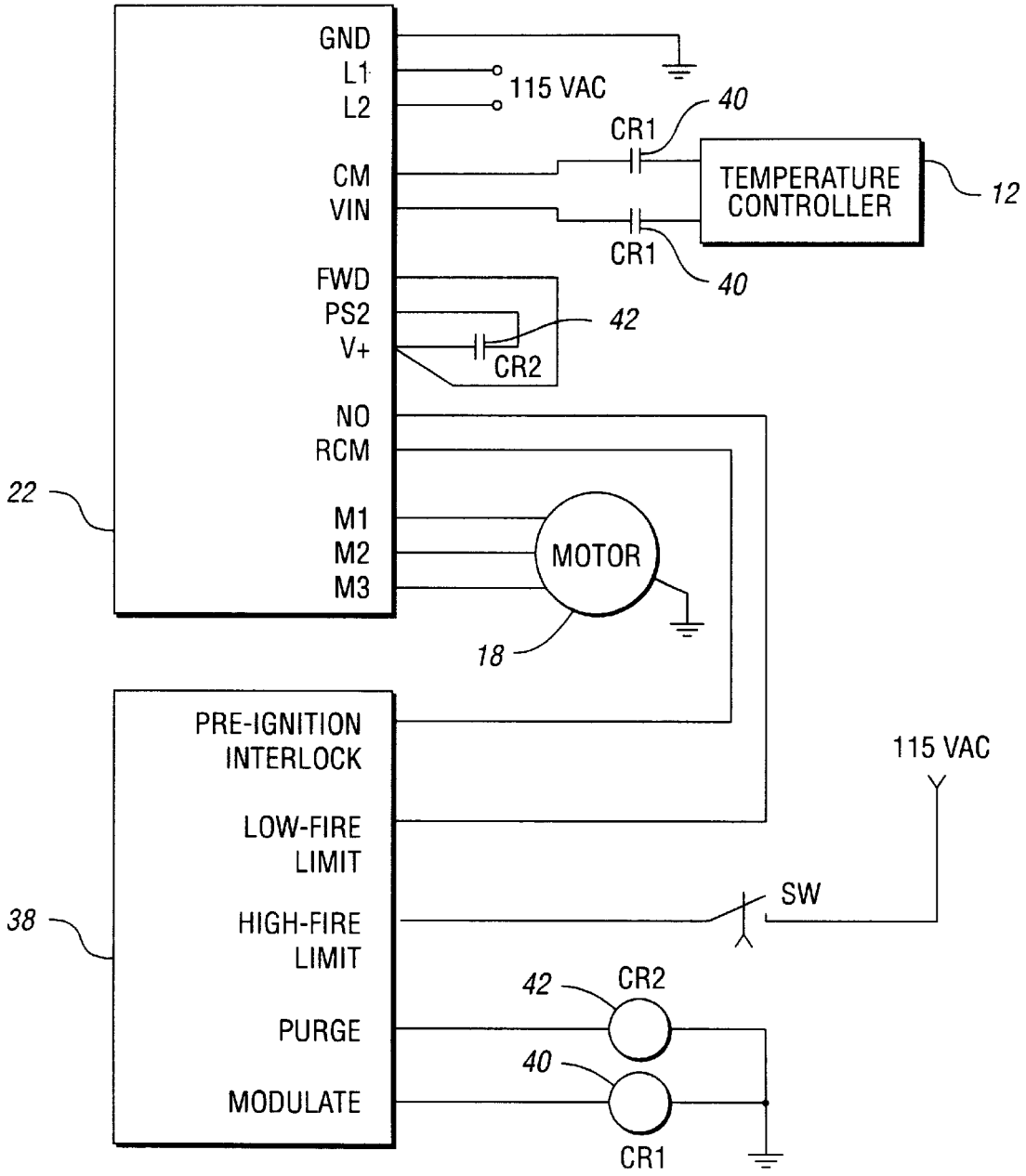
FIG. 3 is a schematic illustrating the interconnection of the temperature controller, blower motor controller, motor and flame safety device of the exemplary burner assembly of FIG. 1.

FIGS. 1 and 2 show a gas burner assembly 10 constructed in accordance with the invention for generating heated combustion products in response to a demand or control signal generated by a temperature sensor 12, which may be a thermocouple that senses the temperature of a processing chamber such as a heating chamber of a glass sheet processing system, etc. The burner assembly 10 includes a circumferential-flow combustion air blower 14 having axial inflow and tangential outflow at its discharge 16. The blower 14 is driven by a variable-speed blower motor 18, itself driven by a burner controller 20 including a blower controller 22 which receives the control signal from the temperature controller 12, in a manner described more fully below. The burner assembly 10 and the method of operation thereof will be described in an integrated manner to facilitate an understanding of the different aspects of the invention.

Figure 4:
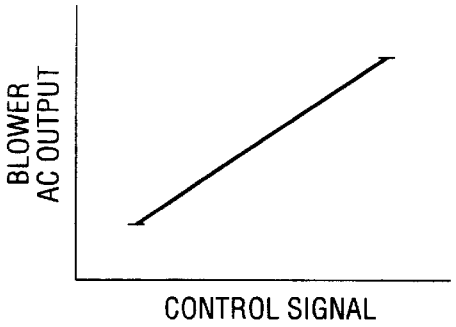
FIG. 4 is a graphical representation showing the relationship of the blower AC output to the control signal.

While any suitable blower 14, blower motor 18 and blower controller 22 may be used, in an exemplary constructed embodiment, the blower 14 is integrated within an Eclipse Thermjet Burner Model No. TJ-100-M. The exemplary blower motor 18 is a General Electric three-phase motor Model No. 5K36MN340 rated at ¾ hp at 60 Hz, with a maximum speed of 3450 RPM. The blower controller 22 used in the exemplary constructed embodiment is sold by T B Woods under Model No. XFC1001-0B, generating a three-phase output ranging from 3.5 to 230 VAC at frequencies between about 23 Hz and about 60 Hz (for a nominal 60 Hz input). Such a blower controller 22 is nominally capable of 0.1 Hz resolution, thereby providing approximately 370 highly-repeatable "steps" between a minimum frequency of 23 Hz and a maximum frequency of 60 Hz, which is provided by a minimum control signal of 4 milliamps from the temperature control 12 and a maximum control signal of 20 milliamps from the temperature controller. The frequency of the blower controller output varies in proportion to the control signal from the temperature controller in a linear manner between its minimum and maximum as shown in FIG. 4.

Figure 5:
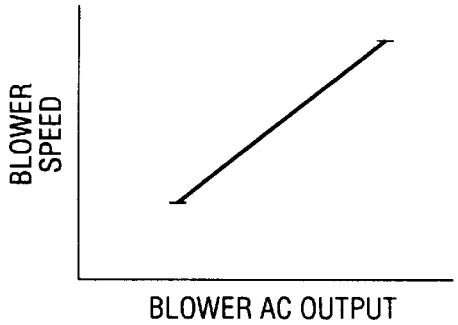
FIG. 5 is a graphical representation showing the relationship of the blower speed to the blower AC output.
Figure 6:
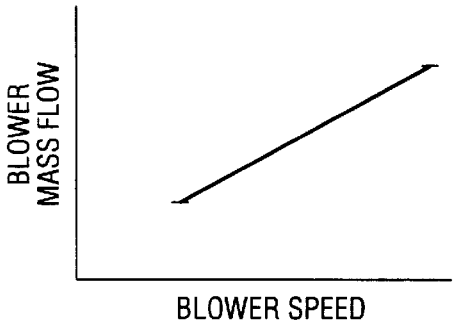
FIG. 6 is a graphical representation showing the relationship of the blower mass flow to the blower speed.
Figure 7:
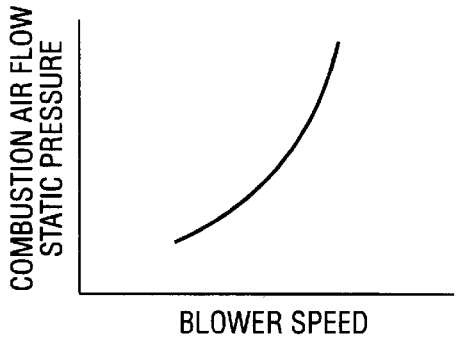
FIG. 7 is a graphical representation showing the relationship of the combustion air flow static pressure to the blower speed.

The blower 14 provides a mass flow rate of combustion air at its discharge 16 ranging from about 3600 scfh when the blower controller 22 supplies its minimum frequency AC output to the blower motor 18, corresponding to a "low-fire" condition, to about 10,500 scfh when the blower controller 22 supplies its maximum frequency AC output to the blower motor 18, corresponding to a "high-fire" condition. The blower motor 18 is driven by, and has a speed proportional to the frequency of, the AC output of the blower controller 22 and is actually linearly proportional thereto between the minimum and maximum frequencies of the AC output of the blower controller as shown in FIG. 5. Likewise, the blower 14 driven by the blower motor generates a combustion air flow with a mass flow proportional to the speed of the blower motor and is actually linearly proportional thereto between the minimum and maximum motor speeds as shown in FIG. 6.

As best seen in FIG. 2, a combustion chamber 24 directly receives the combustion air flow from the blower discharge 16 through an intermediate conduit 26. A gas fuel pressure regulator 28 is responsive to the static pressure of the combustion air flow at the blower discharge 16 by a tap 30, and supplies metered gas fuel, such as natural gas, to the combustion chamber 24 via a suitable nozzle 32. While the invention contemplates any suitable pressure regulator 28, in the exemplary constructed embodiment, the pressure regulator 28 is a Krom Schroder air/fuel-ratio regulator Model No. G1B/25. The static pressure of the combustion air flow at the blower discharge 16 is proportional to the square of the speed of the blower motor.

Figure 8:
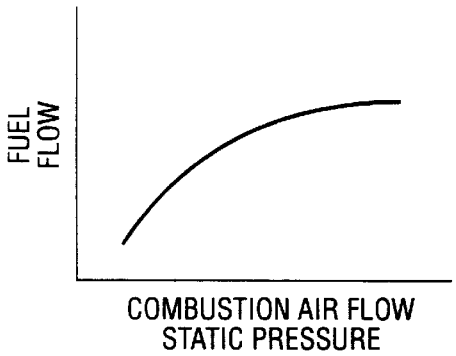
FIG. 8 is a graphical representation showing the relationship of the fuel flow to the combustion air flow static pressure.

The pressure regulator 28 accurately meters gas fuel in proportion to the square root of the static pressure of the combustion air at the blower discharge 16 as shown in FIG. 8 to thereby achieve the desired air-to-fuel ratio for any given control signal between "low-fire" and "high-fire" conditions. Returning to FIG. 1, the burner assembly 10 is shown as also including a suitable ignitor 34, such as a flamerod or spark ignitor, for igniting the mix of combustion air and fuel achieved within the combustion chamber 24.

Figure 9:
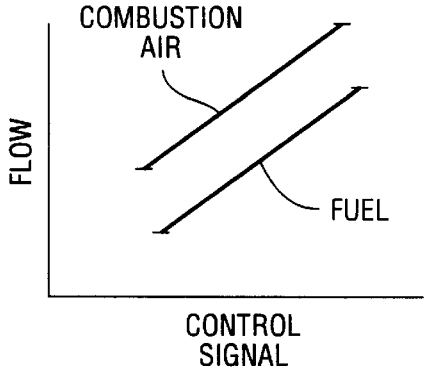
FIG. 9 is a graphical representation showing the relationship of the flow of combustion air and fuel to the control signal.

Due to the manner in which the blower controller has a variable frequency AC output whose frequency is proportional to the control signal and the fact that the blower motor has a speed proportional to the frequency of the AC output of the blower controller as well as the fact that the blower has a mass flow proportional to the speed of the blower motor and a static pressure at the blower discharge 16 proportional to the square of the speed of the blower motor, both the combustion air flow and the gas fuel flow whose mass flow is proportional to the square root of the static pressure of the combustion air flow are proportional to the control signal and specifically linearly proportional to the control signal as shown in FIG. 9. The following Table I sets forth specific values for the control signal, the blower motor controller output frequency, the power percentage, the percent of excess combustion air, the combustion air flow, and the gas fuel flow.

TABLE I

| Control Signal (mA) | Blower Motor Controller Output Freq. (Hz) | Power % | Excess Combustion Air | Combustion Air Flow scfh | Gas Fuel Flow scfh |
|---|---|---|---|---|---|
| 4.0 | 23.0 | 0 | 1000 | 3634 | 35 |
| 5.6 | 26.7 | 10 | 247 | 4309 | 132 |
| 7.2 | 30.4 | 20 | 132 | 4984 | 228 |
| 8.8 | 34.1 | 30 | 85 | 5659 | 325 |
| 10.4 | 37.8 | 40 | 59 | 6334 | 421 |
| 12.0 | 41.5 | 50 | 43 | 7009 | 518 |
| 13.6 | 45.2 | 60 | 33 | 7684 | 614 |
| 15.2 | 48.9 | 70 | 25 | 8359 | 711 |
| 16.8 | 52.6 | 80 | 19 | 9034 | 807 |
| 18.4 | 56.3 | 90 | 14 | 9709 | 904 |
| 20.0 | 60.0 | 100 | 10 | 10384 | 1000 |

Figure 10:
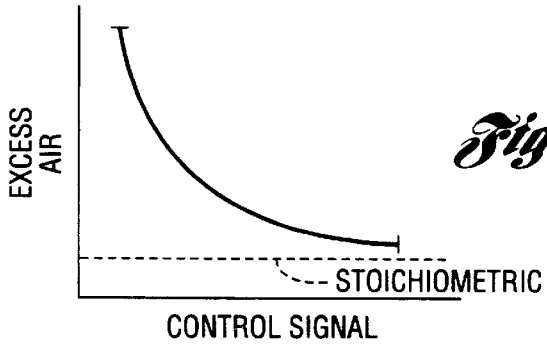
FIG. 10 is a graphical representation showing the relationship of the excess air to the control signal with respect to a stoichiometric condition.

As is apparent from the above values, the blower controller 22 provides a low-fire condition where there is excess combustion air that is a plurality of times the combustion air necessary for stoichiometric combustion with the gas fuel and specifically about 10 times the combustion air necessary for the stoichiometric combustion with the gas fuel as shown in FIG. 10. Furthermore, the burner assembly has a maximum control signal that provides a high-fire condition where there is excess air that is only a fraction of the combustion air necessary for stoichiometric combustion with the gas fuel and specifically there is excess air that is about 10% of the combustion air necessary for stoichiometric combustion with the gas fuel as shown in FIG. 10. As is also apparent from the above, the frequency of the output of the blower controller varying substantially linearly in proportion to the control signal between the minimum and maximum control signals provides the combustion air mass flow and gas fuel mass flow also varying substantially linearly in proportion to the control signal between its minimum and maximum.

In accordance with a feature of the invention, the gas burner assembly 10 includes a fuel cut-off valve 36, such as a Dungs blocking valve, between the pressure regulator 28 and the combustion chamber 24. The burner controller 20 preferably also includes a flame safety device 38 to provide the controller 20 with additional logic control, for example, at burner start-up. A pair of external relays 40,42 controlled by the flame safety device 38 are connected to the blower motor controller 22, as illustrated schematically in FIG. 3. Upon opening the first external relay 40, the connection between the temperature controller 12 and the blower motor controller 22 is interrupted while the blower motor controller 22 is forced to generate its preset minimum frequency AC control signal. Upon closing the second relay 42, the blower motor controller 22 is forced to generate its maximum frequency AC control signal. As explained in greater detail below, the first and second external relays 40,42 are thus advantageously used by the flame safety device 38 to safely ignite the burner assembly at start-up.

In operation, the set-up parameters are preferably programmed to obtain the following sequence of operation: upon initial application of power to the blower motor controller 22 and with the blocking valve 36 operating to cut-off the flow of fuel to the combustion chamber 24, the first external relay 40 is opened to prevent receipt by the blower motor controller 22 of the control signal from the temperature controller 12 while further forcing the blower motor controller 22 to generate an AC control signal at the minimum operating frequency (e.g., 23 Hz). In this manner, upon opening of the first external relay 40, a mass flow rate of air into the combustion chamber 24 is provided sufficient to establish a "low-fire" condition.

With the blocking valve 36 still closed, the flame safety device 38 thereafter initiates a purge by closing the second external relay 42, whereupon the blower motor controller 22 generates an AC control signal at the maximum operating frequency (e.g., 60 Hz), thereby providing a mass flow rate of air into the combustion chamber 24 sufficient to achieve a "high-fire" condition. An unshown pressure switch responsive to the sensed static pressure of the combustion air flow in the blower discharge 16 is adjusted to close an unshown relay contact whenever the air pressure corresponds to the "high-fire" condition, thereby initiating a purge timer in the flame safety device 38. The combustion air flow continues without any gas fuel flow so as to provide an initial purging of a processing chamber prior to eventual heating thereof by the gas burner assembly.

When the purge timer expires, the second external relay 42 opens and the blower motor controller 22 generates an AC output at the minimum frequency (e.g., 23 Hz), thereby reinitiating the "low-fire" condition. An auxiliary relay contact in the blower motor controller is programmed to then close whenever its AC output is at the minimum frequency (e.g. 23 Hz) which corresponds to the "low-fire" condition, whereupon the blocking valve 36 is opened and the ignition sequence is enabled.

After the burner is ignited, the flame safety device 38 closes the first external relay 40, whereupon the blower motor controller 22 receives the control signal from the temperature controller 12 and thereafter generates its AC output in linear proportion to the control signal as previously described.

In accordance with a further feature of the invention, a plurality of gas burner assemblies 10 can be employed in an array responsive to a single control signal to thereby provide uniform operation of all of the burner assemblies. Such an array improves over known burner assemblies employing either a common plenum wherein additional dampers would be required to mechanically calibrate and thereafter adjust the supply of combustion air to each individual burner, or fuel-driven burner assemblies wherein, for example, any deterioration in the performance of the controlling fuel valve would result in an immediate modification of the amount of fuel supplied to the combustion chamber.

As is apparent from the above description, the operation of the gas burner assembly is independent of the particular gas burner utilized and provides for a very accurate and repeatable control of the combustion air and gas fuel flows with a very simple control scheme requiring few setup adjustments and little maintenance. Furthermore, although the gas burner assembly has been described using a high thermal turndown for convection heating processes, it also lends itself nicely to on-ratio turndown by making a simple adjustment to the bias level setting on the fuel proportional regulator for the low fire condition with the combustion air blower controlled in the same manner as previously described.

While the best mode for carrying out the invention has been described in detail, those familiar with the art to which this invention relates will recognize various alternative designs and embodiments for carrying out the invention as defined by the following claims.

It is claimed:

1. A gas burner assembly for generating heated combustion products in response to a control signal, the burner assembly comprising:

a burner controller having a blower controller that receives the control signal and generates a variable frequency AC output whose frequency is linearly proportional to the control signal;

a blower motor driven by, and having a speed linearly proportional to the frequency of, the AC output of the blower controller;

a blower driven by the blower motor to generate a combustion air flow with a mass flow linearly proportional to the speed of the blower motor, and the combustion air flow having a static pressure at a blower discharge location proportional to the square of the speed of the blower motor;

a gas fuel controller responsive to the static pressure of the combustion air flow at the blower discharge location and providing a gas fuel flow whose mass flow is proportional to the square root of the static pressure of the combustion air flow; and a combustion chamber receiving the combustion air flow and the gas fuel flow for combustion.

2. A gas burner assembly for generating heated combustion products in response to a control signal, the burner assembly comprising:

a burner controller having a blower controller that receives the control signal and generates a variable frequency AC output whose frequency is proportional to the control signal;

a blower motor driven by, and having a speed proportional to the frequency of, the AC output of the blower controller;

a blower driven by the blower motor to generate a combustion air flow with a mass flow proportional to the speed of the blower motor, and the combustion air flow having a static pressure at a blower discharge location proportional to the square of the speed of the blower motor;

a gas fuel controller responsive to the static pressure of the combustion air flow at the blower discharge location and providing a gas fuel flow whose mass flow is proportional to the square root of the static pressure of the combustion air flow;

a combustion chamber receiving the combustion air flow and the gas fuel flow for combustion; and wherein the burner assembly has a minimum control signal that controls the blower controller to provide a low-fire condition where there is excess combustion air that is a plurality of times the combustion air necessary for stoichiometric combustion with the gas fuel, and the burner assembly having a maximum control signal that provides a high-fire condition where there is excess combustion air that is only a fraction of the combustion air necessary for stoichiometric combustion with the gas fuel.

3. A gas burner assembly as in claim 2 wherein the low-fire condition has excess combustion air that is about 10 times the combustion air necessary for stoichiometric combustion with the gas fuel, and the high-fire condition having excess combustion air that is about 10% of the combustion air necessary for stoichiometric combustion with the gas fuel.

4. A gas burner assembly as in claim 2 or 3 wherein the frequency of the AC output of the blower controller varies substantially linearly in proportion to the control signal between the minimum and maximum control signals such that the combustion air mass flow and the gas fuel mass flow also vary substantially linearly in proportion to the control signal between its minimum and maximum.

5. A gas burner assembly as in claim 2 wherein the blower controller generates the minimum control signal upon initial combustion of the burner assembly.

6. A gas burner assembly as in claim 1 including an ignitor in the combustion chamber for providing the initial combustion of the burner assembly.

7. A gas burner assembly as in claim 6 wherein the burner controller controls the operation of the ignitor and generates a maximum frequency AC output for a predetermined time period prior to operating the ignitor.

8. A gas burner assembly for generating heated combustion products in response to a control signal, the burner assembly comprising:

a burner controller having a blower controller that receives the control signal and generates a variable frequency AC output whose frequency is proportional to the control signal;

a blower motor driven by, and having a speed proportional to the frequency of, the AC output of the blower controller;

a blower driven by the blower motor to generate a combustion air flow with a mass flow proportional to the speed of the blower motor, and the combustion air flow having a static pressure at a blower discharge location proportional to the square of the speed of the blower motor;

a gas fuel controller responsive to the static pressure of the combustion air flow at the blower discharge location and providing a gas fuel flow whose mass flow is proportional to the square root of the static pressure of the combustion air flow;

a combustion chamber receiving the combustion air flow and the gas fuel flow for combustion;

an ignitor in the combustion engine for providing the initial combustion of the burner assembly, and the burner controller controlling the operation of the ignitor and generating a maximum frequency AC output for a predetermined time period prior to operating the ignitor; and a gas fuel cut-off valve disposed between the fuel controller and the combustion chamber, and the burner controller closing the fuel cut-off valve to prevent the gas fuel flow during the predetermined time period prior to operation of the ignitor.

9. A gas burner assembly for generating heated combustion products in response to a control signal, the burner assembly comprising:

a blower controller that receives the control signal and generates a variable frequency AC output whose frequency is linearly proportional to the control signal;

a blower motor driven by, and having a speed linearly proportional to the frequency of, the AC output of the blower controller;

a blower driven by the blower motor to generate a combustion air flow with a mass flow linearly proportional to the speed of the blower motor, and the combustion air flow having a static pressure at a blower discharge location proportional to the square of the speed of the blower motor;

a gas fuel controller responsive to the static pressure of the combustion air flow at the blower discharge location and providing a gas fuel flow whose mass flow is proportional to the square root of the static pressure of the combustion air flow;

a combustion chamber receiving the combustion air flow and the gas fuel flow for combustion;

the gas burner assembly having a minimum control signal that controls the blower controller to provide a low-fire condition where there is excess combustion air that is a plurality of times the combustion air necessary for stoichiometric combustion with gas fuel, and the burner assembly having a maximum control signal that provides a high-fire condition where there is excess combustion air that is only a fraction of the combustion air necessary for stoichiometric combustion with the gas fuel;

an ignitor in the combustion chamber for providing the initial combustion of the burner assembly;

the burner controller controlling operation of the ignitor and generating a maximum frequency AC output for a predetermined time period prior to operating the ignitor; and a gas fuel cut-off valve disposed between the fuel controller and the combustion chamber, and the burner controller closing the fuel cut-off valve to prevent the gas fuel flow during the predetermined time period prior to operation of the ignitor.

10. A method for controlling combustion of a gas burner assembly comprising:

feeding a control signal to a blower controller that generates a variable frequency AC output linearly proportional to the control signal;

driving a blower motor by, and at a speed linearly proportional to, the frequency of the AC output of the blower controller;

driving a blower by the blower motor to generate a combustion air flow with a mass flow linearly proportional to the speed of the blower motor and with a static pressure at a blower discharge location proportional to the square of the speed of the blower motor;

controlling a gas fuel flow in response to the static pressure of the combustion air flow to provide a gas fuel mass flow proportional to the square root of the static pressure of the combustion air flow; and mixing the combustion air flow and gas fuel flow for combustion.

11. A method for controlling a gas burner assembly comprising:

feeding a control signal to a blower controller that generates a variable frequency AC output proportional to the control signal;

driving a blower motor by, and at a speed proportional to, the frequency of the AC output of the blower controller;

driving a blower by the blower motor to generate a combustion air flow with a mass flow proportional to the speed of the blower motor and with a static pressure at a blower discharge location proportional to the square of the speed of the blower motor;

controlling a gas fuel flow in response to the static pressure of the combustion air flow to provide a gas fuel mass flow proportional to the square root of the static pressure of the combustion air flow;

mixing the combustion air flow and gas fuel flow for combustion; and varying the control signal between a minimum and a maximum, with the minimum control signal providing a low-fire condition where there is excess combustion air that is a plurality of times the combustion air necessary for stoichiometric combustion with the gas fuel, and with the maximum control signal providing a high-fire condition where there is excess combustion air that is a fraction of the combustion air necessary for stoichiometric combustion with the gas fuel.

12. A method for controlling a gas burner assembly as in claim 11 wherein the low-fire condition is provided with excess combustion air that is about 10 times the combustion air necessary for stoichiometric combustion with the gas fuel, and with the high-fire condition being provided with excess combustion air that is about 10% of the combustion air necessary for stoichiometric combustion with the gas fuel.

13. A method for controlling a gas burner assembly as in claim 11 or 12 wherein the frequency of the AC output of the blower controller is varied substantially linearly in proportion to the control signal between its minimum and maximum such that the combustion air mass flow and the gas fuel mass flow also both vary substantially linearly in proportion to the control signal between its minimum and maximum.

14. A method for controlling a gas burner assembly as in claim 11 wherein the blower controller generates the minimum control signal upon initial combustion of the burner assembly.

15. A method for controlling a gas burner assembly as in claim 10 wherein an ignitor provides the initial combustion of the burner assembly.

16. A method for controlling a gas burner assembly as in claim 15 wherein the blower controller drives the blower motor by a maximum frequency AC output for a predetermined time period prior to operation of the ignitor to provide the initial combustion.

17. A method for controlling a gas burner assembly as in claim 16 wherein there is no gas fuel flow during the predetermined time period prior to operation of the ignitor.

18. A method for controlling combustion of a gas burner assembly comprising:

feeding a control signal to a blower controller that generates a variable frequency AC output linearly proportional to the control signal between a minimum and a maximum;

driving a blower motor by, and at a speed linearly proportional to, the frequency of the AC output of the blower controller;

driving a blower by the blower motor to generate a combustion air flow with a mass flow linearly proportional to the speed of the blower motor and with a static pressure at a blower discharge location proportional to the square of the speed of the blower motor;

controlling a gas fuel flow in response to the static pressure of the combustion air flow to provide a gas fuel mass flow proportional to the square root of the static pressure of the combustion air flow;

mixing the combustion air flow and gas fuel flow for combustion, with the minimum control signal providing a low-fire condition where there is excess combustion air that is a plurality of times the combustion air necessary for stoichiometric combustion with the gas fuel, and with the maximum control signal providing a high-fire condition where there is excess combustion air that is a fraction of the combustion air necessary for stoichiometric combustion with the gas fuel;

an ignitor providing the initial combustion of the burner assembly; and the blower controller driving the blower motor by a maximum frequency AC output for a predetermined time period prior to operation of the ignitor to provide the initial combustion, and there being no gas fuel flow during the predetermined time period prior to operation of the ignitor.

* * * * *